US011413889B2

(12) United States Patent
Takahashi et al.

(10) Patent No.: US 11,413,889 B2
(45) Date of Patent: Aug. 16, 2022

(54) PRINTING APPARATUS AND PRINTING METHOD

(71) Applicant: SCREEN Holdings Co., Ltd., Kyoto (JP)

(72) Inventors: Susumu Takahashi, Kyoto (JP); Hiroyuki Kataoka, Kyoto (JP); Satoshi Yasuda, Kyoto (JP); Tetsuya Ishida, Kyoto (JP); Masahiko Soma, Kyoto (JP); Hiroshi Nishide, Kyoto (JP)

(73) Assignee: SCREEN Holdings Co., Ltd., Kyoto (JP)

( * ) Notice: Subject to any disclaimer, the term of this patent is extended or adjusted under 35 U.S.C. 154(b) by 71 days.

(21) Appl. No.: 17/049,705

(22) PCT Filed: Nov. 5, 2018

(86) PCT No.: PCT/JP2018/040953
§ 371 (c)(1),
(2) Date: Dec. 21, 2020

(87) PCT Pub. No.: WO2019/098063
PCT Pub. Date: May 23, 2019

(65) Prior Publication Data

US 2021/0237486 A1 Aug. 5, 2021

(30) Foreign Application Priority Data

Nov. 16, 2017 (JP) ..... JP2017-220860

(51) Int. Cl.
*B41J 11/66* (2006.01)
*B41J 11/70* (2006.01)

(52) U.S. Cl.
CPC ..... *B41J 11/663* (2013.01); *B41J 11/70* (2013.01)

(58) Field of Classification Search
CPC ..... B41J 11/663; B41J 11/70
See application file for complete search history.

(56) References Cited

U.S. PATENT DOCUMENTS

2011/0242187 A1* 10/2011 Mongeon ..... B41J 29/393 347/19
2012/0194597 A1* 8/2012 Okamoto ..... B41J 11/663 347/16

(Continued)

FOREIGN PATENT DOCUMENTS

JP H08-123114 A 5/1996
JP 2011-177943 A 9/2011

(Continued)

OTHER PUBLICATIONS

Notice of Reasons for Refusal dated May 11, 2021 in counterpart Japanese Patent Application No. 2017-220860 with English translation obtained from Global Dossier.

(Continued)

*Primary Examiner* — Scott A Richmond
(74) *Attorney, Agent, or Firm* — Ostrolenk Faber LLP

(57) ABSTRACT

A printing apparatus configured to print on a continuous sheet to be cut into a plurality of cut sheets at a plurality of cutting positions while being conveyed, includes a conveyance mechanism configured to convey the continuous sheet, and a print head provided so as to face a conveyance path for the continuous sheet in the conveyance mechanism and configured to sequentially print a plurality of cutting marks indicating the plurality of cutting positions on the continuous sheet being conveyed by the conveyance mechanism, in which, from between front end portions and rear end portions of each of the pages in a conveyance direction of the continuous sheet in the conveyance mechanism when printing by the print head is performed, the print head prints the (Continued)

cutting marks on the rear end portions for a plurality of pages on the continuous sheet corresponding to the plurality of cut sheets.

7 Claims, 14 Drawing Sheets

(56) References Cited

U.S. PATENT DOCUMENTS

| | | | |
|---|---|---|---|
| 2014/0307020 | A1 | 10/2014 | Toriihara |
| 2017/0344861 | A1 | 11/2017 | Shirasaka |
| 2021/0241053 | A1 | 8/2021 | Takahashi et al. |

FOREIGN PATENT DOCUMENTS

| | | | |
|---|---|---|---|
| JP | 2016-153234 | A | 8/2016 |
| JP | 2019-089302 | A | 6/2019 |
| WO | WO 2019/098063 | A1 | 5/2019 |

OTHER PUBLICATIONS

Extended European Search Report and Opinion dated Aug. 20, 2021 in counterpart European Patent Application No. 21163618.8.

International Search Report dated Dec. 4, 2018 in corresponding PCT International Application No. PCT/JP2018/040953.

Written Opinion dated Dec. 4, 2018 in corresponding PCT International Application No. PCT/JP2018/040953.

International Preliminary Report on Patentability dated May 19, 2020 in corresponding PCT International Application No. PCT/JP2018/040953.

Decision of Refusal dated Nov. 2, 2021 in counterpart Japanese Patent Application No. 2017-220860 with English translation obtained from One Portal Dossier.

* cited by examiner

PRINTING APPARATUS AND PRINTING METHOD

CROSS-REFERENCE TO RELATED APPLICATIONS

The present application is a 35 U.S.C. §§ 371 national phase conversion of International Application No. PCT/JP2018/040953, filed Nov. 5, 2018, which claims priority to Japanese Patent Application No. 2017-220860, filed Nov. 16, 2017, the contents of both of which are incorporated herein by reference. The PCT International Application was published in the Japanese language.

TECHNICAL FIELD

The present disclosure relates to a technique for printing a cutting mark indicating a cutting position for cutting a long continuous sheet.

BACKGROUND ART

Patent Document 1 discloses a printing apparatus which repeatedly performs two processes along the longitudinal direction of a continuous sheet, including, while conveying a long continuous sheet, printing a cutting mark in a non-image area, and printing an image in an image area that locates rear in the continuous sheet in the conveyance direction with respect to the cutting mark. The apparatus obtains a plurality of cut sheets by cutting each non-image region located in front of each image region in the conveyance direction with a cutter based on each cutting mark formed in each non-image region.

PRIOR ART DOCUMENTS

Patent Documents

[Patent Document 1] Japanese Patent Application Laid-Open No. 2011-177943

SUMMARY

Problem to be Solved by the Invention

The printing apparatus of Patent Document 1 prints a cutting mark on each page of a plurality of pages on a continuous sheet corresponding to a plurality of cut sheets only at the front end portion of the page in the continuous sheet in the conveyance direction. FIG. 16 illustrates a continuous sheet WPD printed with two cutting marks CMD1 and CMD2 by the printing apparatus. The cutting mark CMD1 (CMD2) is printed at the front end portion of the page PD1 (PD2) in the conveyance direction Y1 of the continuous sheet WPD at the time of printing for each page PD1 (PD2) on the continuous sheet WPD corresponding to the two cut sheets. The printing apparatus prints, on each page, an image (not illustrated) corresponding to the image data supplied from the host computer or the like on the rear side of the cutting mark in the conveyance direction Y1.

The printing apparatus detects the cutting mark CMD1 (CMD2) based on an output signal SGD1 of a photo sensor or the like facing the movement path of the cutting mark while conveying the continuous sheet WPD, and specifies the cutting position HD1 (HD2) based on the cutting mark CMD1 (CMD2). If the conveyance direction Y2 of the continuous sheet WPD at the time of cutting is the same as the conveyance direction Y1 at the time of printing, the printing apparatus sequentially cuts the continuous sheet WPD at the cutting positions HD1 and HD2 to cut out the cut sheet CPD1 corresponding to the page PD1. Further, the printing apparatus cuts out the cut sheet CPD2 corresponding to the page PD2 by assuming that the pages PD1 and PD2 have the same length, identifying the cutting position HD3 that serves as the rear end of page PD2 in conveyance direction Y1, and cutting the continuous sheet WPD at the cutting position HD3.

However, as illustrated in FIG. 16, when the conveyance directions Y1 and Y2 are opposite to each other, the printing apparatus needs to cut out the cut sheets CPD2, CPD1 in this order by cutting the continuous sheet WPD at each cutting position in the order of cutting positions HD3, HD2, HD1. When the continuous sheet WPD is conveyed along the conveyance direction Y2, the cutting marks CMD2 and CMD1 pass through the measurement values of the photosensor in this order. The cutting mark corresponding to the cutting position HD3 is not formed.

Therefore, the printing apparatus is unable to detect the cutting position HD3 and unable to cut out the cut sheet CPD2.

In order to cut out the cut sheet CPD2 from the continuous sheet WPD conveyed in the conveyance direction Y2 by the printing apparatus, as illustrated in FIG. 17, it is necessary that a dummy page PDX is provided in the rear of the page PD2 in the conveyance direction Y1, and a cutting mark CMDX indicating the cutting position HDX on the front end portion in the conveyance direction Y1 in the dummy page PDX is printed. In this case, the cutting position HDX can be specified based on the cutting mark CMDX, and the continuous sheet WPD can be cut at the cutting position HDX. However, the dummy page PDX is excessively consumed from the continuous sheet WPD at the time of printing due to printing of the cutting mark CMDX, and the sheet consumption increases.

The present disclosure has been made to solve these problems, and an object thereof is to provide a technique that can form a cutting mark that allows cutting a continuous sheet into a cut sheet on the continuous sheet while suppressing the consumption of the continuous sheet, even if the conveyance direction of the continuous sheet during printing is different from (opposite to) the conveyance direction of the continuous sheet when it is cut into a cut sheet.

Means to Solve the Problem

In order to solve the above problem, a printing apparatus according to a first mode is configured to print on a continuous sheet to be cut into a plurality of cut sheets at a plurality of cutting positions arranged in a longitudinal direction while being conveyed in the longitudinal direction, includes a conveyance mechanism configured to convey the continuous sheet in the longitudinal direction, and a print head provided so as to face a conveyance path for the continuous sheet in the conveyance mechanism and configured to sequentially print a plurality of cutting marks indicating the plurality of cutting positions on the continuous sheet being conveyed by the conveyance mechanism, in which, from between front end portions and rear end portions of each of the pages in a conveyance direction of the continuous sheet in the conveyance mechanism when printing by the print head is performed, the print head prints the cutting marks on the rear end portions for a plurality of pages on the continuous sheet corresponding to the plurality of cut sheets.

A printing apparatus according to a second mode which is the printing apparatus according to the first mode, which further includes a reception unit configured to receive designation that, from between the front end portions and the rear end portions of the pages, ones that are designated as the target portions at which the cutting marks to be printed, in which when the reception unit accepts the designation that the front end portions of the pages are the target portions, the print head prints the cutting marks at the front end portions of the pages, and when the reception unit accepts the designation that the rear end portions of the pages are the target portions, the print head prints the cutting marks at the rear end portions of the pages.

A printing apparatus according to a third mode which is the printing apparatus according to the first mode, which further includes an information acquisition unit configured to acquire information indicating whether or not a first conveyance direction of the continuous sheet in the conveyance mechanism when the printing by the print head is performed and a second conveyance direction of the continuous sheet when the continuous sheet is cut into the plurality of cut sheets are a same, and a determination unit configured to determine the front end portions of the pages as target portions at which the cutting marks to be printed when the first conveyance direction and the second conveyance direction are the same, and determine the rear end portions of the pages as target portions at which the cutting marks to be printed when the first conveyance direction is different from the second conveyance direction in the information acquired by the information acquisition unit, in which the print head prints the cutting marks on the target portions of the pages.

A printing apparatus according a fourth mode is the printing apparatus according to the first mode, in which the print head includes a nozzle row in which a plurality of nozzles are arranged in a direction intersecting the longitudinal direction of the continuous sheet, and the print head prints the cutting marks at the rear end portions of the pages in the continuous sheet, and forms line-shaped flushing patterns extending in a width direction of the continuous sheet by performing flushing in which a printing liquid is ejected from the plurality of nozzles toward the rear end portions of the pages.

A printing apparatus according to a fifth mode is the printing apparatus according to the third mode in which the information acquisition unit accepts post-processing machine-related information about a post-processing machine that processes the continuous sheet on which the print head has finished printing and determines the target portions at which the cutting marks to be printed based on the post-processing machine-related information.

A printing apparatus according to a sixth mode is the printing apparatus according to the fifth mode in which the post-processing machine-related information is written, as an image information, in a job provided to the printing apparatus, and the information acquisition unit determines the target portions at which the cutting marks to be printed based on the post-processing machine-related information extracted from the job.

A printing apparatus according to a seventh mode is the printing apparatus according to the fifth mode, in which the post-processing machine-related information is output by a detection sensor configured to detect the post-processing machine connected to the printing apparatus.

A printing method according to an eighth mode is the printing method of printing on a continuous sheet to be cut into a plurality of cut sheets at a plurality of cutting positions arranged in a longitudinal direction while being conveyed in the longitudinal direction, which includes a conveying step of conveying the continuous sheet in the longitudinal direction, and a printing step of sequentially printing a plurality of cutting marks indicating the plurality of cutting positions on the continuous sheet being conveyed in the step of conveying, in which the printing step is a step which, from between front end portions and rear end portions of each of the pages in a conveyance direction of the continuous sheet in the printing step, the cutting marks are printed on the rear end portions for a plurality of pages on the continuous sheet corresponding to the plurality of cut sheets.

A printing method according to a ninth mode is the printing method according to the eighth mode, which further includes a receiving step of accepting designation that ones from between the front end portions and the rear end portions of the pages are designated as the target portions at which the cutting marks to be printed, in which the printing step includes a step of printing the cutting marks on the front end portions of the pages when the designation is accepted in which the front end portions of the pages are designated as the target portions in the reception step, and a step of printing the cutting marks on the rear end portions of the pages when the designation is accepted in which the rear end portions of the pages are designated as the target portions in the reception step.

A printing method according a tenth mode is the printing method according to the eighth mode, which further includes an information acquisition step of acquiring information indicating whether or not a first conveyance direction of the continuous sheet in the conveying step and a second conveyance direction of the continuous sheet when the continuous sheet is cut into the plurality of cut sheets are a same, and a determination step of determining the front end portions of the pages as target portions at which the cutting marks to be printed when the first conveyance direction and the second conveyance direction are the same, and determining the rear end portions of the pages as target portions at which the cutting marks to be printed when the first conveyance direction is different from the second conveyance direction in the information, in which the printing step is a step of printing the cutting marks on the target portions of the pages.

A printing method according to an eleventh mode is the printing method according to the eighth mode, in which the printing step includes a step of printing the cutting marks at the rear end portions of the pages in the continuous sheet, and a forming step of forming line-shaped flushing patterns extending in a width direction of the continuous sheet by performing flushing in which a printing liquid is ejected from a plurality of nozzles toward the rear end portions of the pages.

Effects of the Invention

According to the first mode of the present disclosure, the print head of the printing apparatus prints, of front end portions and rear end portions of each of the pages in a conveyance direction of the continuous sheet in the conveyance mechanism, cutting marks on the rear end portions for a plurality of pages on the continuous sheet corresponding to the plurality of cut sheets. When the conveyance direction of the continuous sheet during printing is different from (opposed to) the conveyance direction of the continuous sheet when cut into a plurality of cut sheets, the last cutting mark printed on the rear end portion of the last page during printing is first detected at the front end portion of the last printed page (the first page to be cut) when cutting continuous sheet. Accordingly, a cutting mark that allows cutting a continuous sheet into a cut sheet on the continuous sheet is formed while suppressing the consumption of the continuous sheet.

According to the second mode of the present disclosure, the printing apparatus prints the cutting mark on the designated portion with the designation of the target portion on which the cutting mark to be printed between the front end portion and the rear end portion of the page.

According to the third mode of the present disclosure, a cutting mark that allows cutting a continuous sheet into a cut sheet on the continuous sheet is formed while suppressing the consumption of the continuous sheet, regardless of the difference between the first conveyance direction of the continuous sheet during printing and the second conveyance direction of the continuous sheet when cutting into a plurality of cut sheets.

According to the fourth mode of the present disclosure, when the cutting mark is printed on the rear end portion of the page on the continuous sheet, the flushing pattern is also formed on the rear end portion; therefore, the consumption of the continuous sheet is further suppressed than in the case where the flushing patter is formed at the end portion opposite to the cutting mark.

According to the eighth mode of the present disclosure, a cutting mark is printed on each page of the plurality of pages on the continuous sheet corresponding to the plurality of cut sheets at the rear end portion of the page in the continuous sheet in the conveyance direction in the conveying step. When the conveyance direction of the continuous sheet during printing is different from (opposed to) the conveyance direction of the continuous sheet when cut into a plurality of cut sheets, the last cutting mark printed on the rear end portion of the last page during printing is first detected at the front end portion of the last printed page (the first page to be cut) when cutting continuous sheet. Accordingly, a cutting mark that allows cutting a continuous sheet into a cut sheet on the continuous sheet is formed while suppressing the consumption of the continuous sheet.

DESCRIPTION OF EMBODIMENT

Hereinafter, Embodiment will be described with reference to the drawings.

<Configuration of Printing System 100A>

Figure 1:
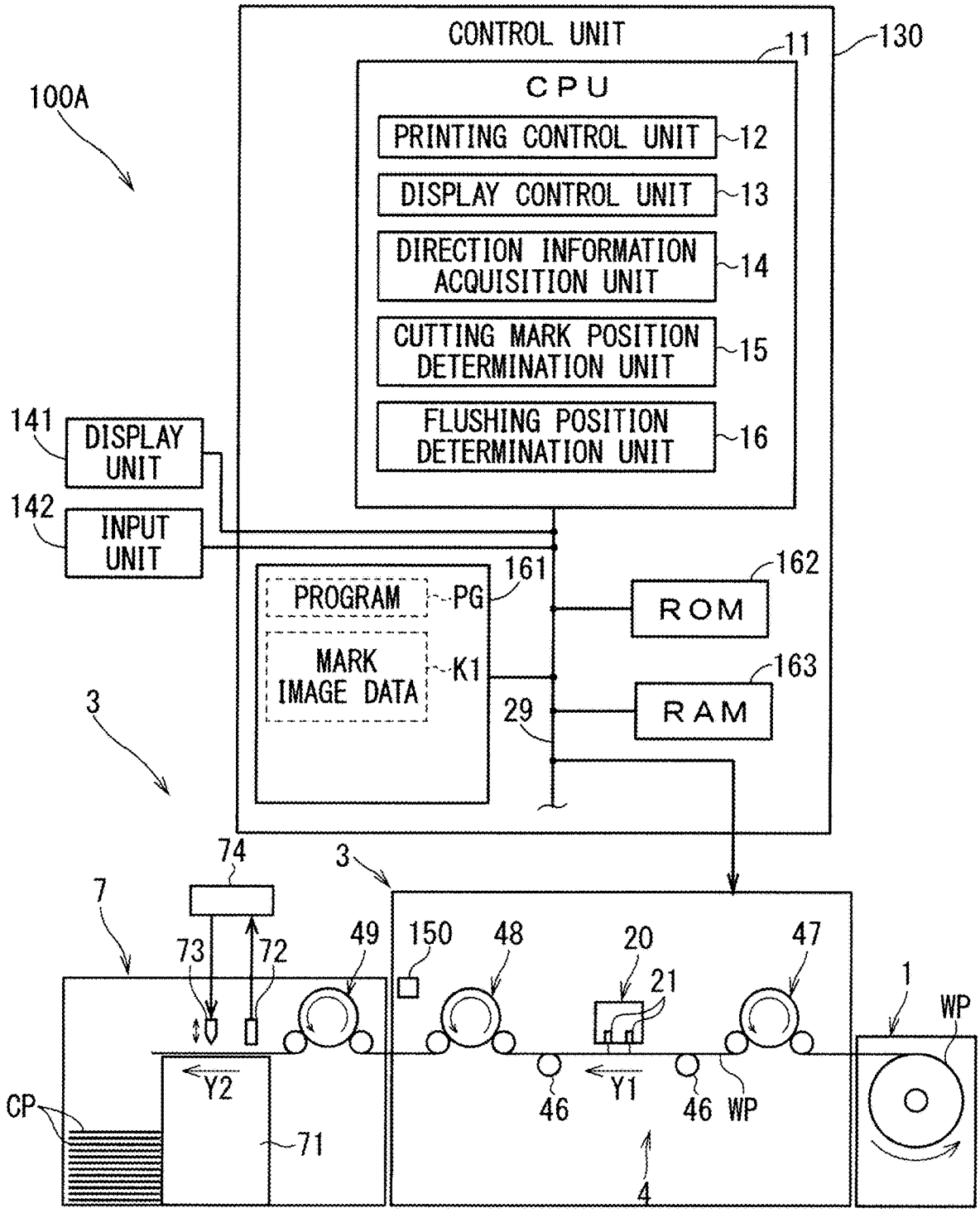
FIG. 1 A schematic view illustrating an overall configuration example of a printing system including a printing apparatus according to Embodiment.

FIG. 1 is a schematic view illustrating an overall configuration example of a printing system 100A including a printing apparatus 3 according to Embodiment.

The printing system (inkjet printing system) 100A includes a paper feeding unit 1, a printing apparatus 3 according to Embodiment, and a cutting unit 7. The printing system 100A also includes a control unit 130 that controls the respective operations of the paper feeding unit 1, the printing apparatus 3, and the cutting unit 7. In the printing system 100A, the cutting unit 7 connected online to the printing apparatus 3 cuts the continuous paper WP after printing into a plurality of cut sheets.

The paper feeding unit 1 rotatably holds the roll-shaped continuous paper (continuous sheet) WP around the horizontal axis, and unwinds and supplies the continuous paper WP to the printing apparatus 3. The continuous paper WP is a long printing medium. The continuous paper WP is cut into a plurality of cut sheets at a plurality of cutting positions arranged in the longitudinal direction while being conveyed in the longitudinal direction thereof.

The printing apparatus 3 includes a conveyance mechanism 4 that conveys the continuous paper WP from the paper feeding unit 1 to the cutting unit 7, and a print head 20 that prints on the continuous paper WP conveyed by the conveyance mechanism 4. The cutting unit 7 takes in the printed continuous paper WP, cuts each page, and stores them together for each job. Assuming that the supply side of the continuous paper WP is the upstream and the discharge side of the continuous paper WP is the downstream, the paper feeding unit 1 is arranged on the upstream side of the printing apparatus 3, and the cutting unit 7 is arranged on the downstream side of the printing apparatus 3. The cutting unit 7 is detachably connected to the printing apparatus 3.

The printing apparatus 3 includes a detection sensor 150 that detects a post-processing machine such as the cutting unit 7. The detection sensor 150 detects whether or not a post-processing machine such as the cutting unit 7 is connected to the printing apparatus 3, and when it is connected, information on the type of the post-processing machine (information indicating whether or not the continuous paper WP can be cut online included), and inputs the information to the control unit 130 as post-processing machine-related information d1.

The conveyance mechanism 4 of the printing apparatus 3 is provided with a drive roller 47 for taking in the continuous paper WP from the paper feeding unit 1 on the upstream side. The continuous paper WP unwound from the paper feeding unit 1 by the drive roller 47 is conveyed along the plurality of conveyance rollers 46 toward the cutting unit 7 on the downstream side. A drive roller 48 is arranged between the most downstream conveyance roller 46 and the cutting unit 7. The drive roller 48 sends out the continuous paper WP conveyed on the conveyance rollers 46 toward the cutting unit 7. In this manner, the continuous paper WP moves along the conveyance direction Y1 with respect to the printing apparatus 3. The conveyance rollers 46 and the drive rollers 47 and 48 comprise the conveyance mechanisms 4 for conveying the continuous paper WP in the longitudinal direction thereof.

The printing apparatus 3 includes the print head 20 and a drying unit (not illustrated) between the drive roller 47 and the drive roller 48 in this order from the upstream side. The drying unit dries the ink printed by the print head 20.

Figure 2:
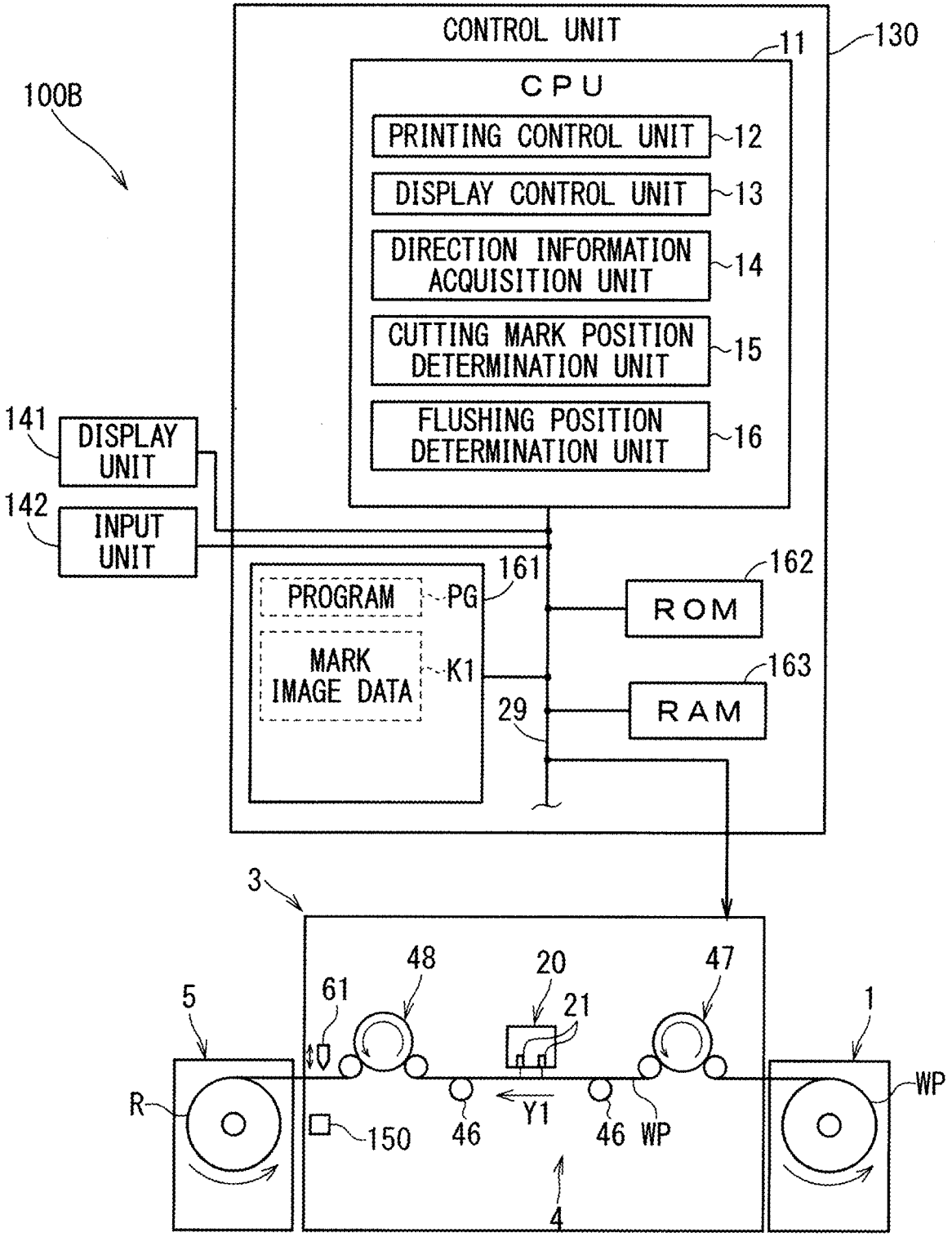
FIG. 2 A schematic view illustrating an other overall configuration example of a printing system including a printing apparatus according to Embodiment.

The print head (inkjet head) 20 includes a plurality of nozzles 21 that eject droplets of ink (printing liquid). The plurality of nozzles 21 are arranged in a direction intersecting the longitudinal direction of the continuous paper WP to form a nozzle row. A plurality of print heads 20 are typically arranged along the conveyance direction Y1 of the continuous paper WP. For example, four print heads 20 are individually provided for black (K), cyan (C), magenta (M), and yellow (Y). However, in the following description, in order to facilitate the understanding of the disclosure, only one print head 20 is illustrated in FIG. 1 and FIG. 2 described later, and the description will be made accordingly. The print head 20 prints a cutting mark on the rear end portion of a page on the continuous paper WP, and also performs flushing in which ink is ejected from the plurality of nozzles 21. The print head 20 forms a line-shaped flushing pattern extending in the width direction of a continuous sheet on the page by flushing.

Figure 4:
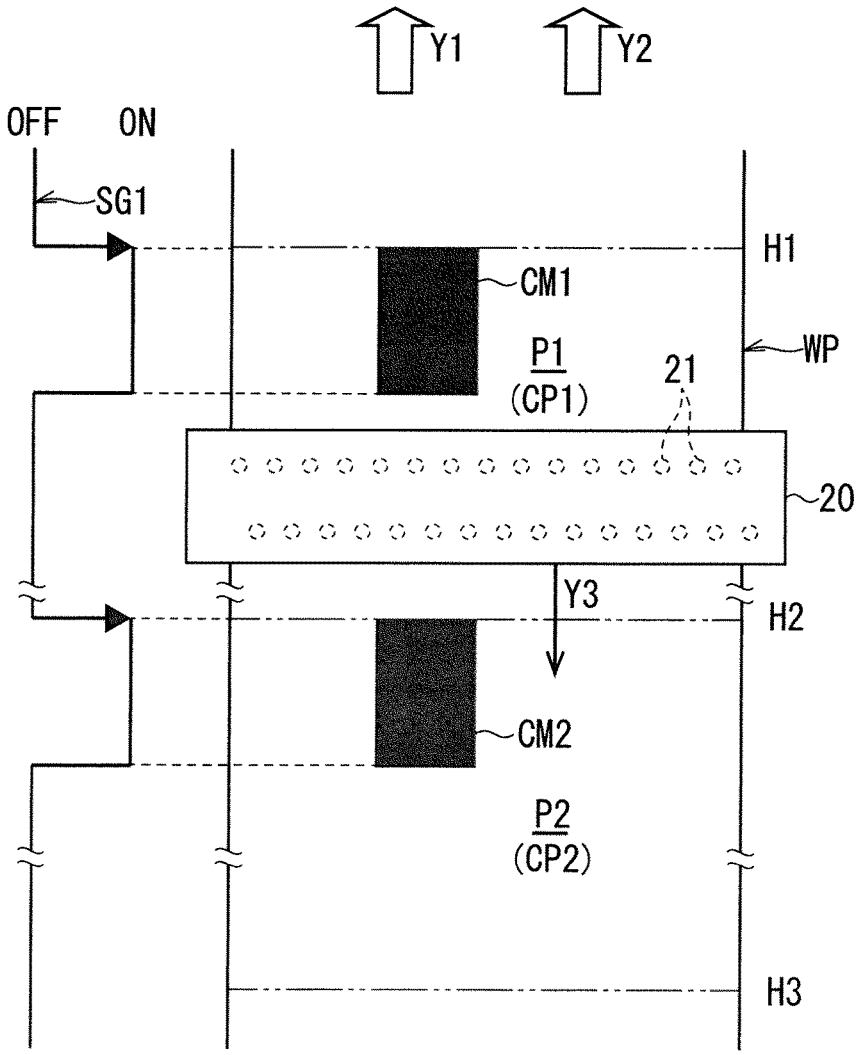
FIG. 4 A plan view illustrating a continuous sheet in which a plurality of cutting marks are printed for a plurality of pages corresponding to the plurality of cut sheets by the printing apparatus according to Embodiment.

As illustrated in FIG. 4 described later, the print head 20 is arranged in a posture in which the longitudinal direction thereof is directed in a direction orthogonal to the conveyance direction Y1 (conveyance path) of the continuous paper WP. The print head 20 is provided so as to face the conveyance direction of the continuous paper WP by the conveyance mechanism 4. The print head 20 preferably has a length equal to or larger than the width of the continuous paper WP. The conveyance direction Y1 and the printing direction Y3 of the continuous paper WP are opposite to each other. That is, the upstream side of the conveyance direction Y1 is the downstream side of the print direction Y3, and the downstream side of the conveyance direction Y1 is the upstream side of the print direction Y3. Of the print heads 20, preferably, the print head 20 for the black (K) prints a cutting mark indicating the cutting position of the continuous paper WP for each page of the plurality of pages. The cutting position is the boundary between adjacent pages. That is, the print head 20 sequentially prints a plurality of cutting marks indicating a plurality of cutting positions on the continuous paper WP conveyed by the conveyance mechanism 4.

The upper portion of each page is set, for example, on the downstream side of the conveyance direction Y1 (conveyance path) (upstream side of the print direction Y3), and the lower portion of each page is set, for example, on the upstream side of the conveyance direction Y1 (conveyance path) (downstream side of direction Y3). The print head 20 performs printing so that the top and bottom of an image to be printed on each page coincide with the top and bottom of each page.

The cutting unit 7 includes a drive roller 49, a base 71, a sensor 72, a cutter unit 73, and a control unit 74. The cutting unit 7 takes in the continuous paper WP fed by the drive roller 48 and sends it onto the base 71 by the drive roller 49 along the conveyance direction Y2. The sensor 72 is composed of, for example, a reflective photo sensor or the like, irradiates the moving path of the cutting mark with light, and outputs an electric signal having intensity corresponding to the intensity of the reflected light from the continuous paper WP. The electric signal is binarized at a predetermined threshold value and output. The electric signal is supplied to the control unit 74 of the cutting unit 7. The control unit 74 sequentially detects each cutting mark based on the electric signal. In order for the cutter unit 73 to cut the continuous paper WP at each cutting position preset for each cutting mark, the control unit 74 adjusts the cutting timing for the cutter unit 73. The cutter unit 73 cuts the continuous paper WP in the width direction at each cutting position at the timing controlled by the control unit 74, and a plurality of cut sheets CP are obtained. The cutting unit 7 sorts and stores the plurality of cut sheets CP for each job.

The control unit 130 is electrically connected to each of the paper feeding unit 1 and the printing apparatus 3 of the printing system 100A, and controls their operations. As the configuration of the control unit 130 as hardware, the same configuration as that of a general computer is adoptable. That is, the control unit 130 is configured by electrically connecting a CPU 11 that performs various arithmetic processing, a ROM 162 being a read-only memory that stores basic programs, a RAM 163 being a memory that is readable and writable and stores various information, and a magnetic disk 161 for storing program PG, data and the like, to a bus line 29, for example.

A display unit 141 such as a liquid crystal panel and an input unit (reception unit) 142 such as a keyboard are also electrically connected to the bus line 29. The input unit 142 also includes an interface for inputting a signal supplied by an external host computer or the like to the control unit 130. The control unit 130 also includes an output interface (not illustrated) that outputs a signal to an external host computer or the like. The magnetic disk 161 also stores mark image data K1 indicating a cutting mark and a flushing pattern, and the like. The magnetic disk 161 also stores various information input by an operator by operating the input unit 142. Examples of the information include specifications of the continuous paper WP (paper width, paper thickness, paper length, etc.), image data to be printed by the print head 20, and the like. The image data is supplied as a job from, for example, an external host computer or the like to the control unit 130 via the input unit 142.

The input unit 142 also accepts designation that designates one from between the front end portion in the conveyance direction Y1 and the rear end portion in the same direction of a page in the continuous paper WP as the target portion to be printed with the cutting mark. When the input unit 142 accepts the designation that designates the front end portion of the page as the target portion, the print head 20 prints the cutting mark on the front end portion of the page, and when the input unit 142 accepts the designation that designates the rear end portion of the page as the target portion, the print head 20 prints the cutting mark on the rear end portion of the page.

In the control unit 130, the CPU 11 as the main control unit performs arithmetic processing in accordance with the procedure described in the program PG, thereby realizing various functional units that control each unit of the printing system 100A. Specifically, the CPU 11 operates as each functional unit such as a printing control unit 12 that controls the operation of the printing apparatus 3, a display control unit 13 that controls the display operation of the display unit 141, a direction information acquisition unit 14, a first determination unit (cutting mark position determination unit) 15 that determines the cutting mark position on each page, and a second determination unit (flushing position determination unit) 16 that determines the flushing position (flushing pattern position), for example. The direction information acquisition unit (information acquisition unit) 14 acquires information indicating whether or not the conveyance direction Y1 of the continuous paper WP when printing is performed by the print head 20 while being conveyed by the conveyance mechanism 4 (first conveyance direction, first direction) and the conveyance direction Y2 of the continuous paper WP when the continuous paper WP is cut into a plurality of cut sheets CP (second conveyance direction, second direction) are the same, that is, information indicating whether or not the continuous paper WP is cut online.

When the conveyance direction Y1 and the conveyance direction Y2 are the same in the information acquired by the direction information acquisition unit 14, the first determination unit 15 determines the front end portion of the page as the target portion to be printed with the cutting mark, and when the conveyance direction Y1 and the conveyance direction Y2 are different, the first determination unit 15 determines the rear end portion of the page as the target portion. Further, the print head 20 prints a cutting mark on the target portion of the page.

In the printing system 100A, the continuous paper WP is cut online, that is, the cutting unit 7 is connected to the printing apparatus 3 online; therefore, the conveyance direction Y1 in the printing apparatus 3 and the conveyance direction Y2 in the cutting unit 7 are the same. Therefore, the first determination unit 15 determines the front end portion of the page as the target portion to be printed with the cutting mark. Then, the print head 20 prints a cutting mark on each page of the plurality of pages on the continuous paper WP corresponding to the plurality of cut sheets CP at the front end portion of the page in the conveyance direction Y1 of the continuous paper WP by the conveyance mechanism 4. The second determination unit 16 determines, from between the front end portion and the rear end portion of the page, the one on which the cutting mark is formed as the flushing position. Therefore, in the printing system 100A, the second determination unit 16 determines the front end portion of the page as the flushing position. The print head 20 forms a flushing pattern at the front end portion.

Note that some or all of the functional units realized by the control unit 130 may be realized in hardware wise by a dedicated logic circuit or the like.

<Configuration of Printing System 100B>

Figure 3:
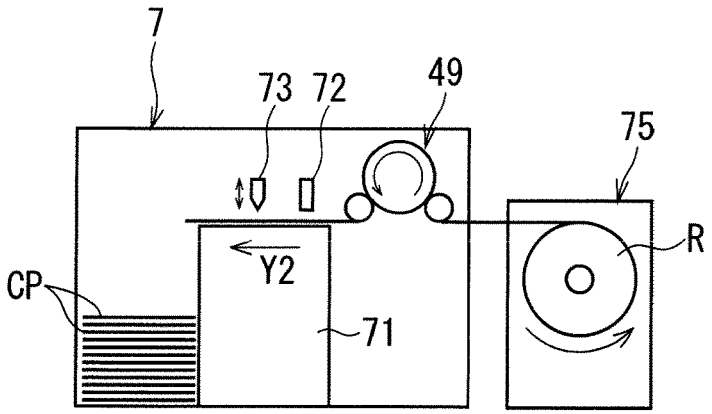
FIG. 3 A schematic diagram illustrating a part of the printing system of FIG. 2.

FIGS. 2 and 3 are schematic views illustrating a partial configuration example of a printing system 100B including the printing apparatus 3.

The printing system (inkjet printing system) 100B includes a paper feeding unit 1, a printing apparatus 3 according to Embodiment, and a paper ejection unit 5. Further, the printing system 100B includes a cutting unit 7. The printing system 100B also includes a control unit 130 that controls the respective operations of the paper feeding unit 1 and the printing apparatus 3.

The printing system 100B differs from the printing system 100A in that the paper ejection unit 5 is connected to the printing apparatus 3 instead of the cutting unit 7, and the paper ejection unit 5 winds and collects the continuous paper WP after printing around the horizontal axis thereof.

Further, the printing apparatus 3 includes a cutter 61 downstream of the drive roller 48. When the printing apparatus 3 finishes one printing job, the cutter 61 cuts the rear end of the continuous paper WP. The paper ejection unit 5 continues to wind and collect the continuous paper WP until the rear end of the continuous paper WP is wound by the roll R of the continuous paper WP. Apart from such differences, the printing system 100B is configured in the same manner as the printing system 100A.

The paper ejection unit 5 winds and collects the continuous paper WP printed by the printing apparatus 3 around the horizontal axis thereof. Assuming that the supply side of the continuous paper WP is the upstream and the discharge side of the continuous paper WP is the downstream, the paper feeding unit 1 is arranged on the upstream side of the printing apparatus 3, and the paper ejection unit 5 is arranged on the downstream side of the printing apparatus 3.

A drive roller 48 is arranged between the most downstream conveyance roller 46 and the paper ejection unit 5. The drive roller 48 sends out the continuous paper WP conveyed on the conveyance rollers 46 toward the paper ejection unit 5.

When the winding and collecting of the continuous paper WP is completed, the operator removes the roll R of the continuous paper WP from the paper ejection unit 5. The operator then conveys the roll R to a cutting machine not connected to the printing apparatus 3 (for example, the cutting unit 7 in FIG. 1) and sets the roll R in a roll holding unit 75 of the cutting unit 7 as illustrated in FIG. 3. While unwinding the continuous paper WP from the roll R, that is, unwinding the continuous paper WP in the conveyance direction Y2 opposite to the conveyance direction at the time of printing, the cutting unit 7 cuts the continuous paper WP into a plurality of cut sheets CP and stores them together for each job.

In the printing system 100B, the continuous paper WP is cut offline by the cutting unit 7 not connected to the printing apparatus 3, that is, the conveyance direction Y1 and the conveyance direction Y2 are different (more accurately, opposite directions). Therefore, the first determination unit 15 determines the rear end portion of the page as the target portion to be printed with the cutting mark. Then, the print head 20 prints a cutting mark on each page of the plurality of pages on the continuous paper WP corresponding to the plurality of cut sheets CP at the rear end portion of the page in the conveyance direction Y1 of the continuous paper WP by the conveyance mechanism 4. Also, the second determination unit 16 determines the rear end portion of the page on which the cutting mark is to be printed as the flushing position. The print head 20 forms a flushing pattern at the rear end portion.

<Cutting Mark Formed by Printing Apparatus 3>

Figure 5:
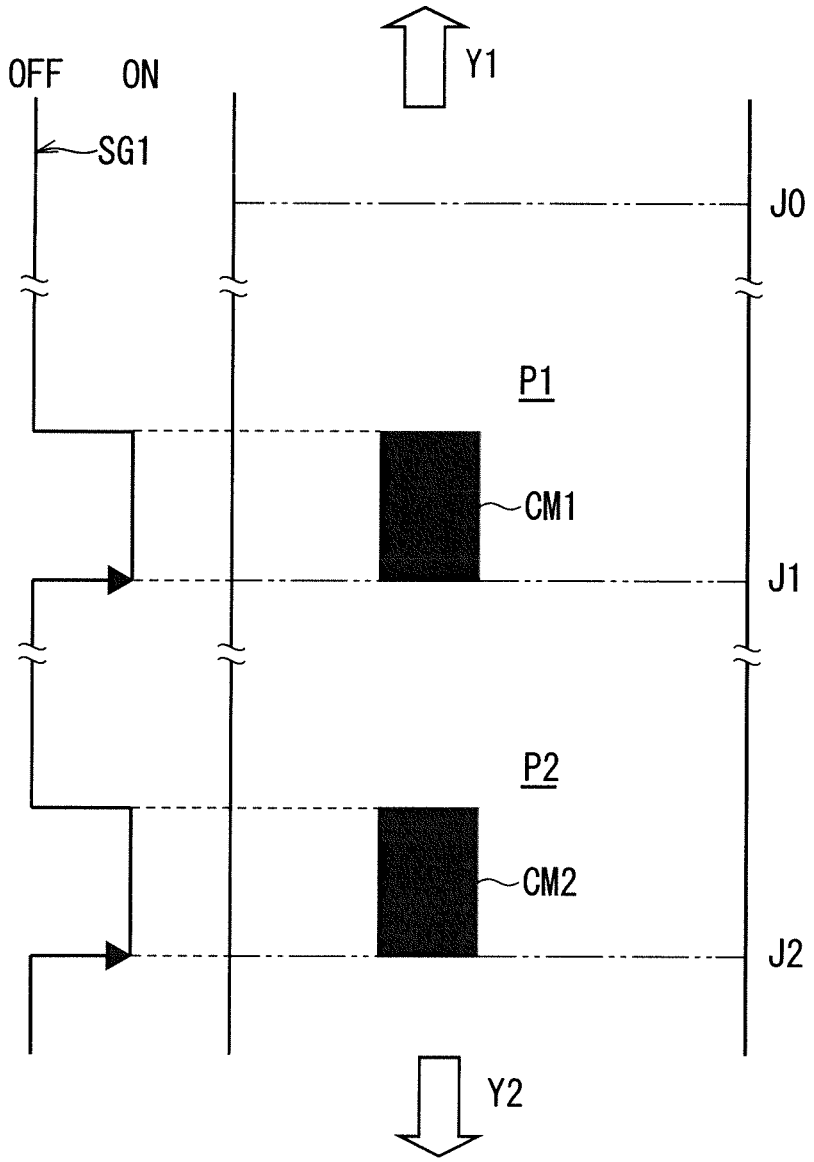
FIG. 5 A plan view illustrating a continuous sheet in which a plurality of cutting marks are printed for a plurality of pages corresponding to the plurality of cut sheets by the printing apparatus according to Embodiment.

FIGS. 4 and 5 are plan views illustrating a continuous sheet in which a plurality of cutting marks are printed for a plurality of pages corresponding to the plurality of cut sheets by the printing apparatus 3.

More specifically, FIG. 4 illustrates the continuous paper WP on which the printing apparatus 3 of the printing system 100A has printed the cutting marks CM1 and CM2. FIG. 5 illustrates the continuous paper WP on which the printing apparatus 3 of the printing system 100B has printed the cutting marks CM1 and CM2.

As illustrated in FIG. 4, in the printing system 100A, the cutting of the continuous paper WP into a plurality of cut sheets CP and printing on the continuous paper WP are performed online. The conveyance direction Y1 of the continuous paper WP at the time of printing and the conveyance direction Y2 of the continuous paper WP at the time of cutting are the same. That is, the conveyance direction Y1 and the conveyance direction Y2 are directions toward which the continuous paper WP moves with the upper portion of each page P1 (P2) of the continuous paper WP being positioned at the top and the lower portion thereof following the upper portion.

Figure 18:
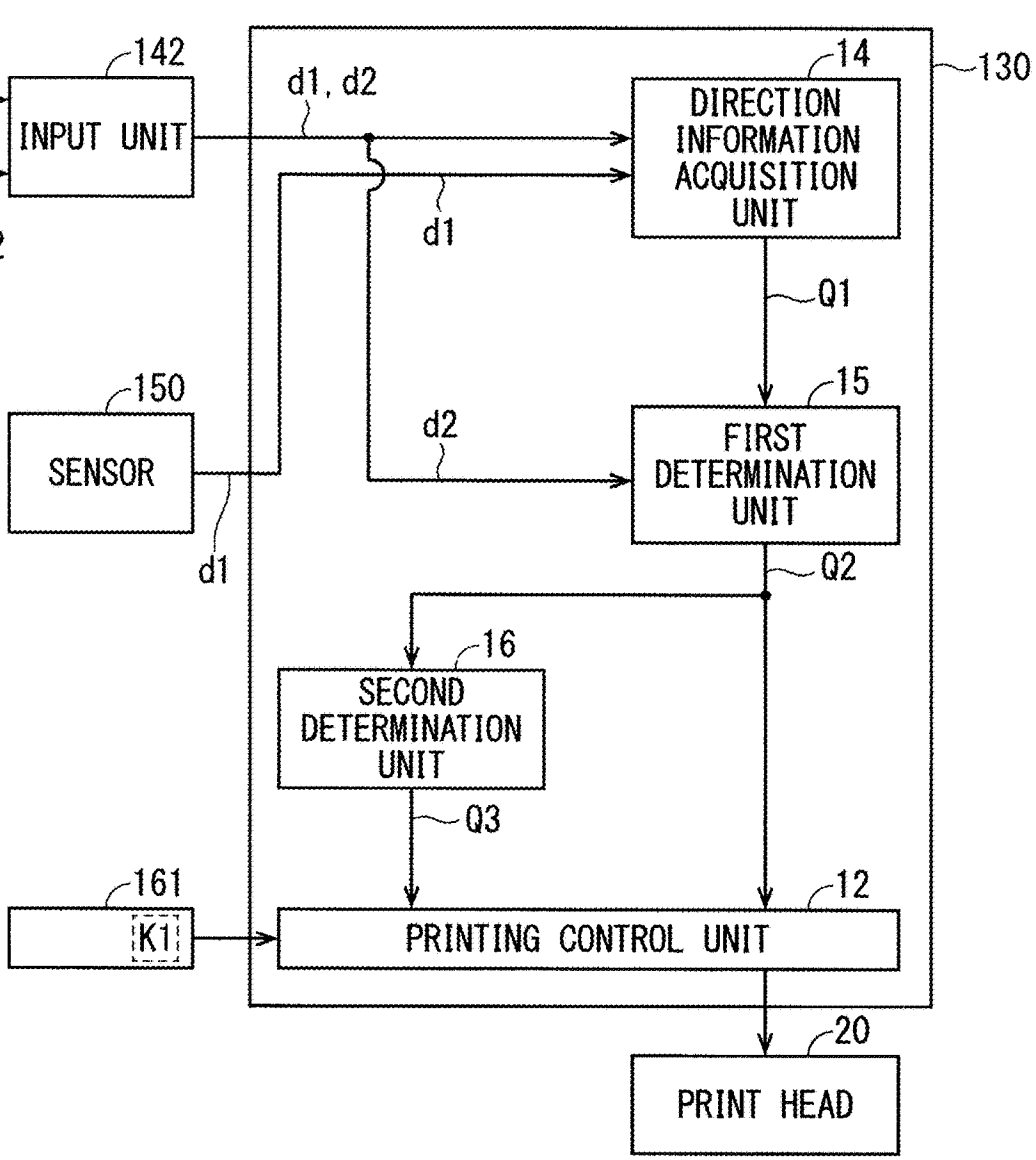
FIG. 18 A functional block diagram for explaining the process of determining the position of the cutting mark by a first determination unit.

FIG. 18 is a functional block diagram for explaining the process of determining the position of the cutting mark position CM by the first determination unit 15. As described above, the detection sensor 150 transmits the post-processing machine-related information d1 (information about the post-processing machine including whether or not the post-processing machine such as the cutting unit 7 is connected to the printing apparatus 3, and if it is connected, whether or not cutting online is possible) to the direction information acquisition unit 14. The direction information acquisition unit 14 transmits information Q1 indicating whether or not the conveyance direction Y1 is the same as the conveyance direction Y2 to the first determination unit 15 based on the information d1.

The post-processing machine-related information d1 may be embedded in the job in advance. In this case, an input unit 142 extracts the post-processing machine-related information d1 from the job and transmits it to the direction information acquisition unit 14. Alternatively, the post-processing machine-related information d1 may be input by the operator via the GUI of the input unit 142.

From the GUI of the input unit 142, the operator can also directly specify the information (cutting mark position information d2) regarding the print position of the cutting mark position CM in the cut sheet CP. The cutting mark position information (also referred to as "cutting mark print position information") d2 includes information indicating whether the cutting mark CM is formed at the front end portion (upper portion) or the rear end portion (lower end) of the cut sheet CP.

In this case, the first determination unit 15 determines the position (cutting mark position) Q2 at which the cutting mark CM should be formed (printed) based on not the information Q1 from the direction information acquisition unit 14, but the cutting mark position information d2.

When the first determination unit 15 determines the cutting mark position Q2 as in a manner described above, the printing control unit 12 drives the print head 20 with reference to the mark image data K1 so as to form a cutting mark CM at the position of the continuous paper WP.

The cutting mark position Q2 determined by the first determination unit 15 is also provided to the second determination unit 16. The second determination unit 16 determines a flushing position Q3 at which the flushing pattern should be formed (printed) at one end of the front end portion and the rear end portion of the cut sheet CP on which the cutting mark is formed. The printing control unit 12 drives the print head 20 with reference to the mark image data K1 so as to form a flushing pattern at the flushing position Q3.

Returning to FIG. 4, when cutting the continuous paper WP, the sensor 72 of the cutting unit 7 outputs an output signal SG1. The control unit 130 detects the cutting mark CM1 (CM2) based on the output signal SG1, specifies the cut position H1 (H2) based on the cutting mark CM1 (CM2), and causes the cutter unit 73 of the cutting unit 7 to perform cutting of the continuous paper WP at the cut position H1 (H2). Further, the control unit 130 specifies a cutting position H3 on the premise that the lengths of the pages P1 (P2) are the same, and causes the cutting unit 7 to perform cutting at the cutting position H3. As a result, each page P1 (P2) of the continuous paper WP is cut into a cut sheet CP1 (CP2).

As illustrated in FIG. 5, in the printing system 100B, the cutting of the continuous paper WP into a plurality of cut sheets CP is performed offline, while printing on the continuous paper WP is performed otherwise. The conveyance direction Y1 of the continuous paper WP at the time of printing and the conveyance direction Y2 of the continuous paper WP at the time of cutting are opposite to each other. That is, while the conveyance direction Y1 is the direction toward which the continuous paper WP moves with the upper portion of each page P1 (P2) of the continuous paper WP being positioned at the top and the lower portion thereof following the upper portion, the conveyance direction Y2 is the direction toward which the continuous paper WP moves with the lower portion of each page P1 (P2) of the continuous paper WP being positioned at the top and the upper portion thereof following the lower portion.

The information that cutting is performed offline is input to the control unit 130 via the input unit 142 in advance before starting printing. When printing the continuous paper WP, the first determination unit 15 determines the position of the cutting mark position CM1 (CM2) at the rear end portion of the page P1 (P2). The print head 20 prints the cutting mark CM1 (CM2) on the continuous paper WP at the rear end portion of the page P1 (P2) in accordance with the decisions of the first determination unit 15 and the second determination unit 16.

When cutting the continuous paper WP, the sensor 72 of the cutting unit 7 outputs the output signal SG1. The control unit 130 sequentially detects the cutting mark CM2 (CM1) based on the output signal SG1, specifies the cut position J2 (J1) based on the cutting mark CM2 (CM1), and causes the cutter unit 73 of the cutting unit 7 to perform cutting of the continuous paper WP at the cut position J2 (J1). Further, the control unit 130 specifies a cutting position J0 at the upper portion of the page P1 on the premise that the lengths of the pages P2 (P1) are the same, and causes the cutting unit 7 to perform cutting at the cutting position J0. As a result, each page P2 (P1) of the continuous paper WP is cut into a cut sheet CP2 (CP1).

<Cutting Mark and Flushing Pattern Formed by Printing Apparatus 3>

FIGS. 6 to 10 are plan views illustrating a continuous sheet in which a cutting mark and a flushing pattern are printed, by the printing apparatus 3, on a page on the continuous sheet corresponding to the cut sheet.

Figure 6:
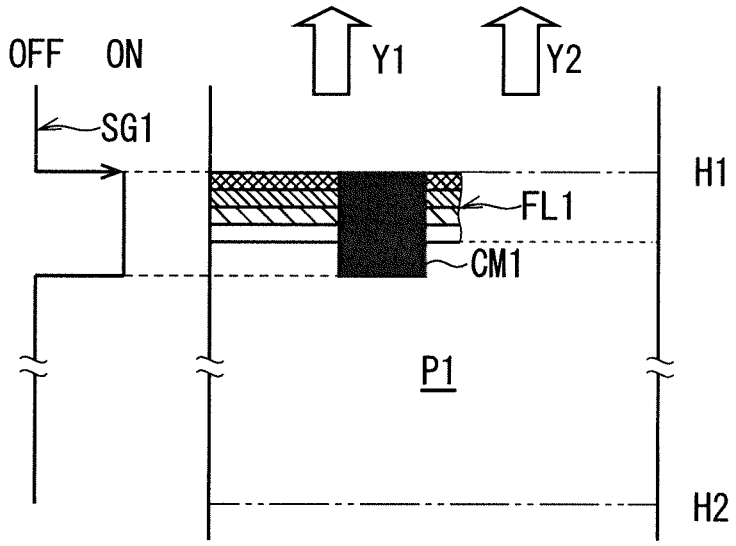
FIG. 6 A plan view illustrating a continuous sheet in which a cutting mark and a flushing pattern are printed on a page corresponding to the cut sheet by the printing apparatus according to Embodiment.
Figure 7:
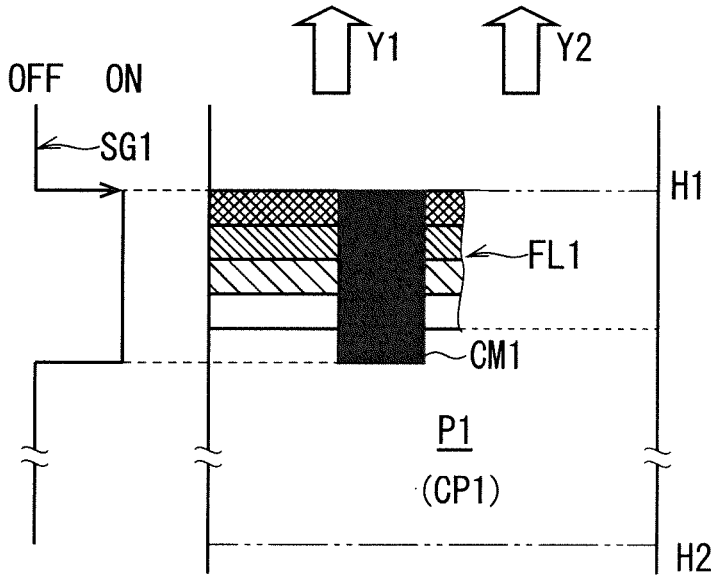
FIG. 7 A plan view illustrating a continuous sheet in which a cutting mark and a flushing pattern are printed on a page corresponding to the cut sheet by the printing apparatus according to Embodiment.

More specifically, similarly to FIG. 4, a cutting mark CM1 for online cutting by the printing system 100A is formed at the front end portion (upper portion) of the page P1 in FIGS. 6 and 7.

Figure 8:
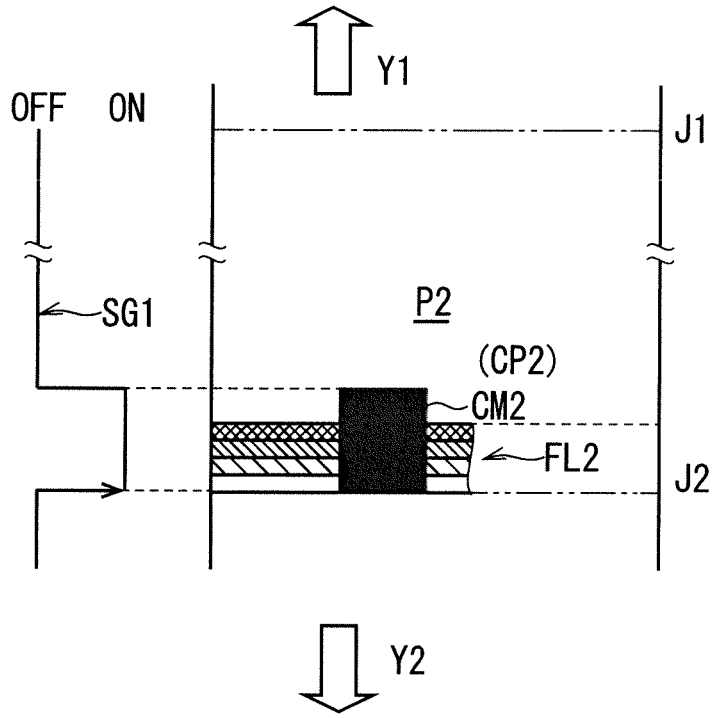
FIG. 8 A plan view illustrating a continuous sheet in which a cutting mark and a flushing pattern are printed on a page corresponding to the cut sheet by the printing apparatus according to Embodiment.
Figure 9:
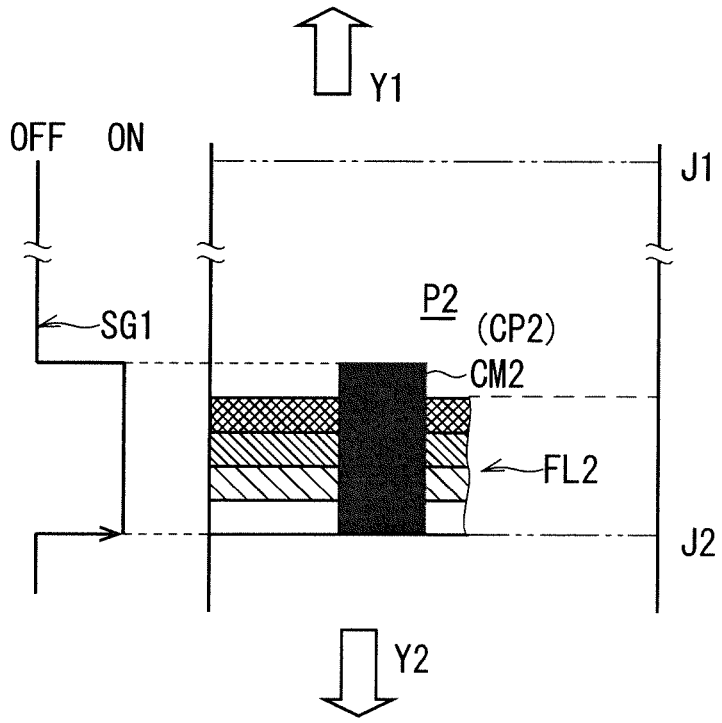
FIG. 9 A plan view illustrating a continuous sheet in which a cutting mark and a flushing pattern are printed on a page corresponding to the cut sheet by the printing apparatus according to Embodiment.
Figure 10:
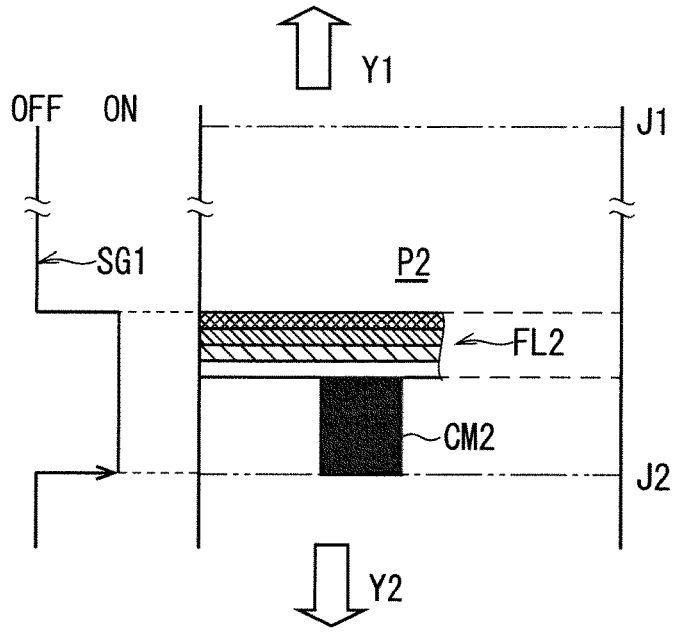
FIG. 10 A plan view illustrating a continuous sheet in which a cutting mark and a flushing pattern are printed on a page corresponding to the cut sheet by the printing apparatus according to Embodiment.

Further, similarly to FIG. 5, a cutting mark CM2 for offline cutting by the printing system 100B is formed at the rear end portion (lower portion) of the page P2 in FIGS. 8 to 10.

Further, unlike FIGS. 4 and 5, the print head 20 flushes, and a flushing pattern is formed, of the both ends of each page, at the same end portion as the cutting mark in FIGS. 6 to 10. In FIGS. 6 and 7, the flushing pattern FL1 is formed at the front end portion (upper portion) of the page P1, and in FIGS. 8 to 10, the flushing pattern FL2 is formed at the rear end (lower portion) of the page P2.

Both of the flushing patterns FL1 and FL2 each include line-shaped pattern extending in the width direction of the continuous paper WP in the order of black (K), cyan (C), magenta (M) from the front end side (upper side) toward the rear end side (lower side) of each page in the conveyance direction Y1.

The sensor 72 of the cutting unit 7 binarizes the output signal in accordance with a predetermined threshold value and outputs thereof. Further, the sensor 72 appropriately changes the signal value at the time when a mark or the like is detected, that is, at the time of ON and the signal value at the time when no mark or the like is detected, that is, at the time of OFF between H and L so that the value of the output signal can conform to the logic of the algorithm for detecting the cutting mark.

Typically, the sensor 72 securely detects the black (K) pattern among the flushing patterns FL1 and FL2. Meanwhile, the cyan (C), magenta (M), and yellow (Y) patterns have lower concentrations than black (K) and may or may not be detected.

The control unit 130 detects a cutting mark when, for example, the output signal SG1 rises and remains in the ON state for a predetermined period (length) longer than the reaction time for dust or the like and then turns OFF.

Therefore, in order to prevent the flushing pattern from being erroneously detected as a cutting mark, the printing apparatus 3 forms a flushing pattern and a cutting mark in a manner that a case where the flushing pattern first reaches a measurement position of the sensor 72 and then the cutting mark reaches the measurement position is avoided in both the online cutting and the offline cutting. That is, the flushing pattern and the cutting mark are formed so as to reach the measurement position at the same time or in a manner that the flushing pattern reaches later.

If the flushing pattern is formed at the top of the page and the cutting mark is formed at the rear end of the page, the flushing pattern may possibly be detected before the cutting mark is detected at the boundary portion of adjacent pages. Therefore, the printing apparatus 3 forms the flushing pattern at the end portion on the same side as the cutting mark. Consequently, the continuous paper WP is prevented from being wasted, as well.

Further, as illustrated in FIG. 7 (FIG. 9), when the flushing pattern is longer in the conveyance direction Y1 than that in FIG. 6 (FIG. 8), the cutting mark also becomes longer accordingly.

Further, in the offline cutting, as illustrated in FIG. 10, the flushing pattern and the cutting mark may be so formed that the rear end of the cutting mark in the conveyance direction Y2 and the front end of the flushing pattern in the conveyance direction Y2 are the same. In this case, the cutting mark is detected by detecting that the ON output of the output signal SG1 continues for a predetermined time or longer.

<Operation of Printing Apparatus 3>

FIGS. 11 to 15 are flowcharts illustrating an example of the operation of the printing apparatus 3 printing on the continuous paper WP.

Figure 11:
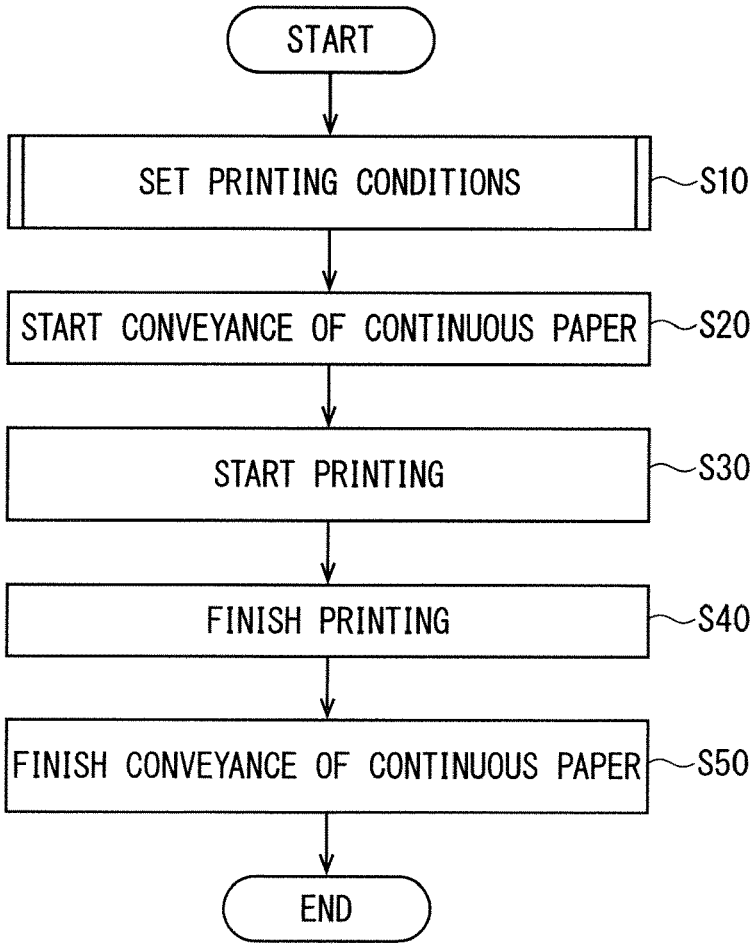
FIG. 11 A flowchart illustrating an example of the operation of the printing apparatus according to Embodiment.

In Step S10 of FIG. 11, the control unit 130 of the printing apparatus 3 sets the printing conditions. When the process of Step S10 starts, the process is transferred to Step S110 of FIG. 12.

In Step S110, the CPU 11 of the control unit 130 acquires the information regarding the cutting mark position accepted by the input unit 142.

Figure 13:
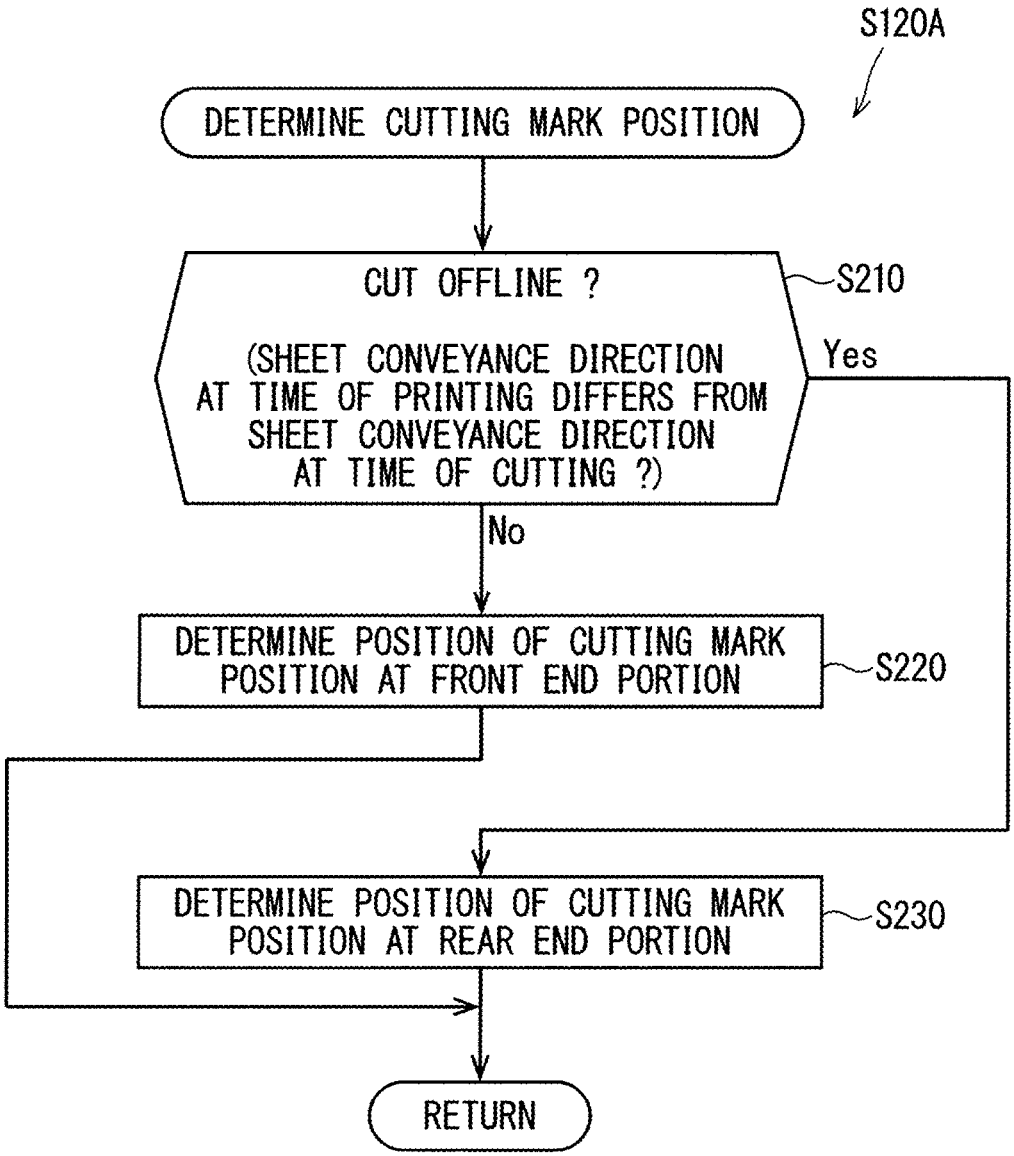
FIG. 13 A flowchart illustrating an example of the operation of the printing apparatus according to Embodiment.
Figure 14:
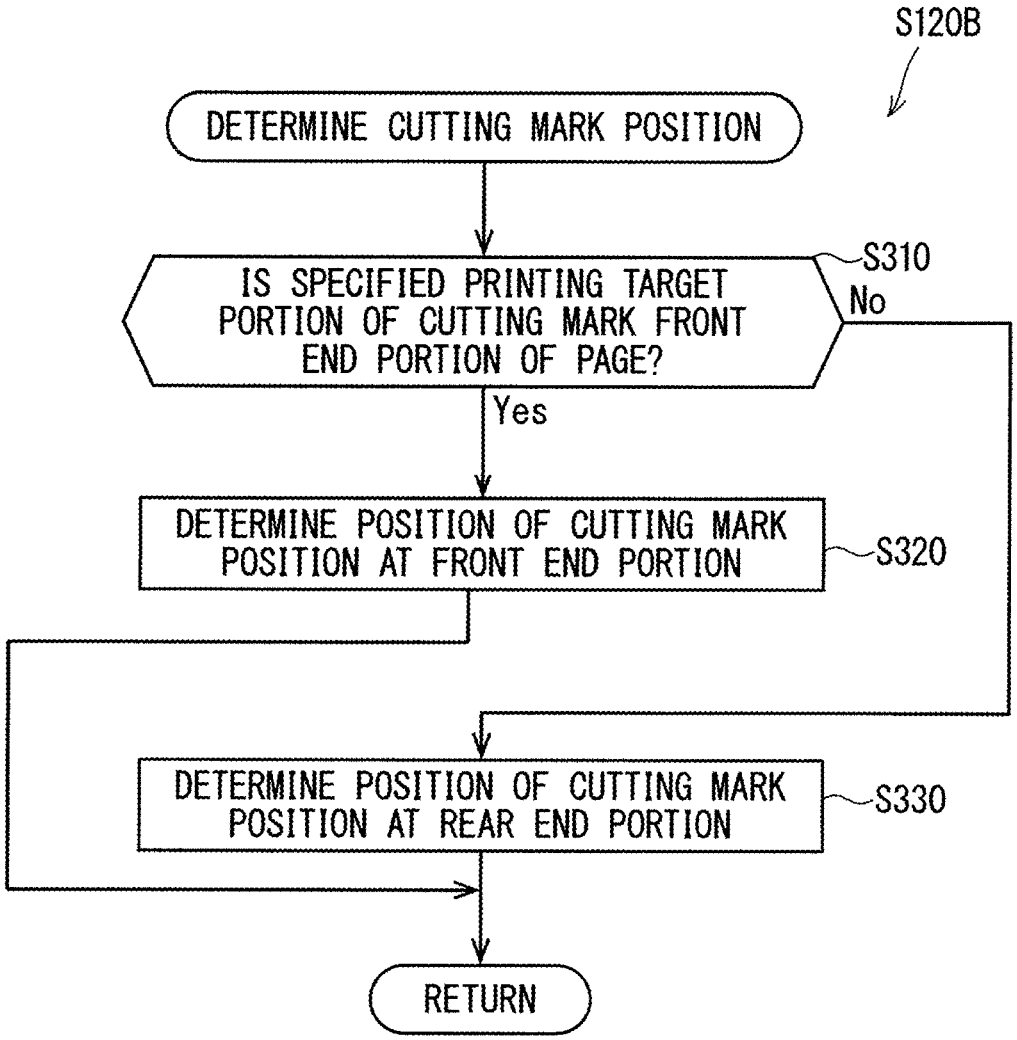
FIG. 14 A flowchart illustrating an example of the operation of the printing apparatus according to Embodiment.
Figure 15:
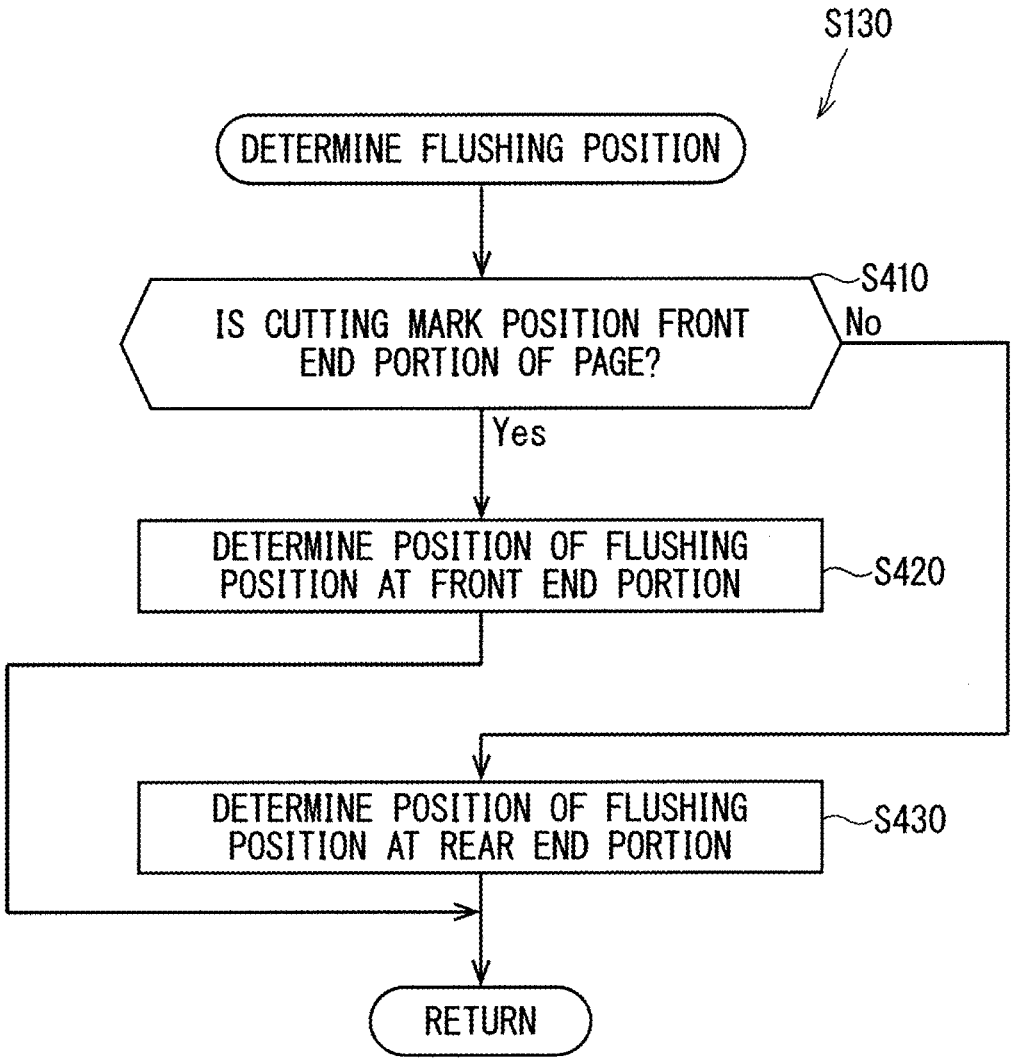
FIG. 15 A flowchart illustrating an example of the operation of the printing apparatus according to Embodiment.
Figure 16:
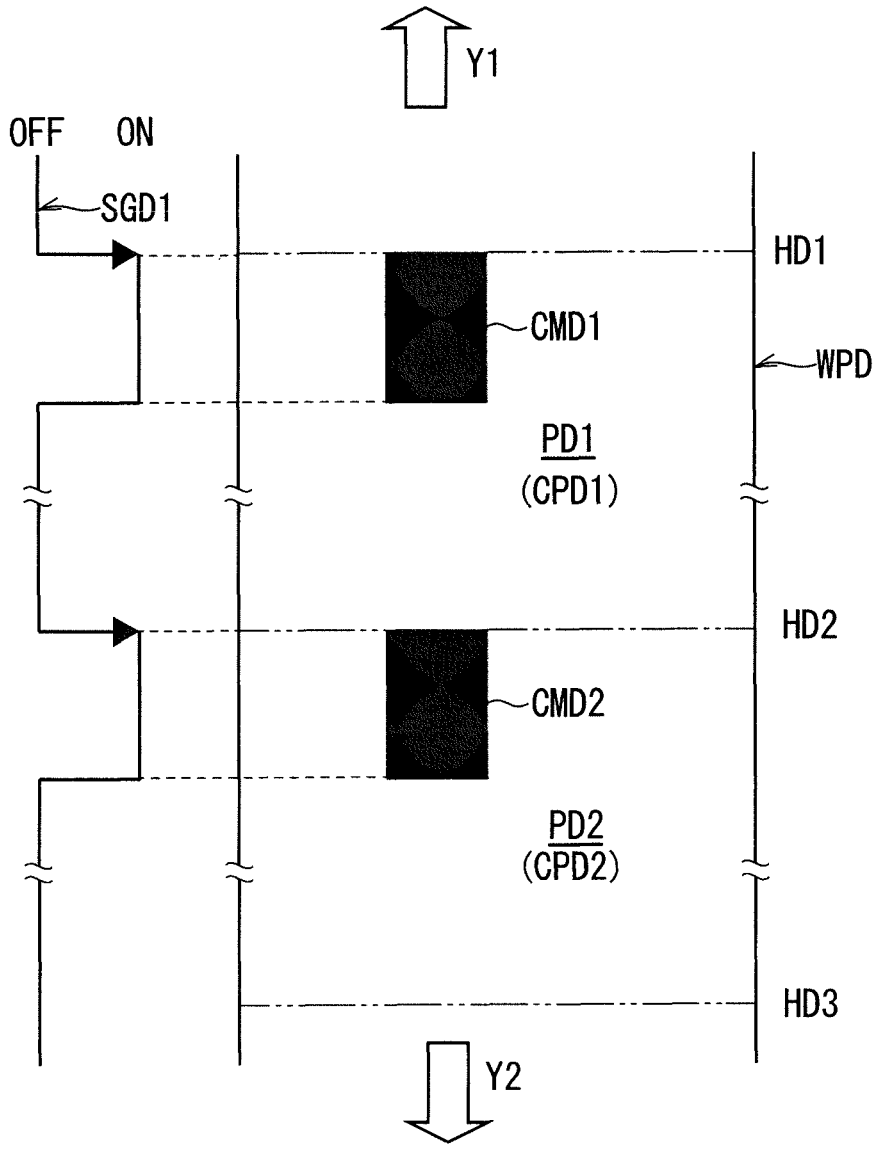
FIG. 16 A plan view illustrating a continuous sheet in which a plurality of cutting marks are printed for a plurality of pages corresponding to the plurality of cut sheets by the printing apparatus according to a prior art.
Figure 17:
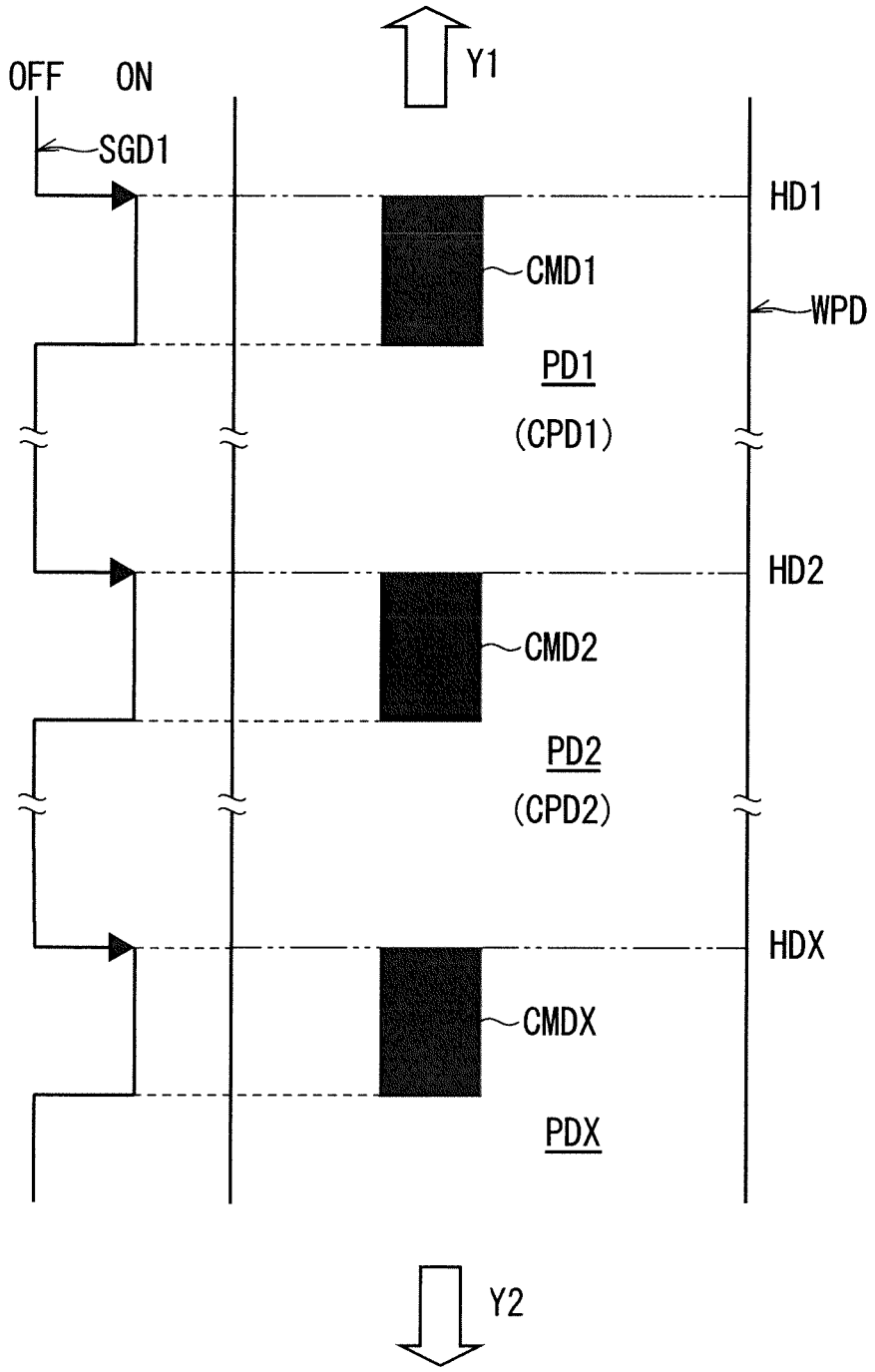
FIG. 17 A plan view illustrating a continuous sheet in which a plurality of cutting marks are printed for a plurality of pages corresponding to the plurality of cut sheets and a dummy page by the printing apparatus according to a prior art.

In Step S120A (S120B), the first determination unit 15 determines the cutting mark position. Here, when the first determination unit 15 determines the cutting mark position with reference to the post-processing machine-related information d1 provided from the input unit 142 or the detection sensor 150, the process is transferred to Step S120A (FIG. 13). Meanwhile, when the first determination unit 15 determines the cutting mark position with reference to the cutting mark position information d2 provided from the input unit 142, the process is transferred to Step S120B (FIG. 14).

Refereeing to FIG. 13, in Step S210, based on the information acquired by the direction information acquisition unit 14 via the input unit 142, the first determination unit 15 determines whether or not the offline cutting is performable, that is, whether or not the conveyance direction Y1 at the time of printing the continuous paper WP differs from the conveyance direction Y2 at the time of cutting the continuous paper WP.

Here, the display control unit 13 is provided, on the GUI of the input unit 142, with a button that allows you to directly specify the print cutting mark position at the front end (upper portion) or the rear end (lower portion) of the page, a button that allows to select the online cutting or the offline cutting, a button that allows to select with or without flushing, when flushing is performed, a button to select between line flushing that flushes the non-image area of the page in strips and discrete flushing that flushes discretely so that it is not noticeable in the image, and the like.

When the result of the determination in Step S210 shows that it is not offline cutting, in Step S220, the first determination unit 15 determines the position of the cutting mark position at the front end portion of the page.

When the result of the determination in Step S210 shows that it is the offline cutting, the process proceeds to Step S230, and the first determination unit 15 determines the position of the cutting mark position at the rear end portion of the page.

Figure 12:
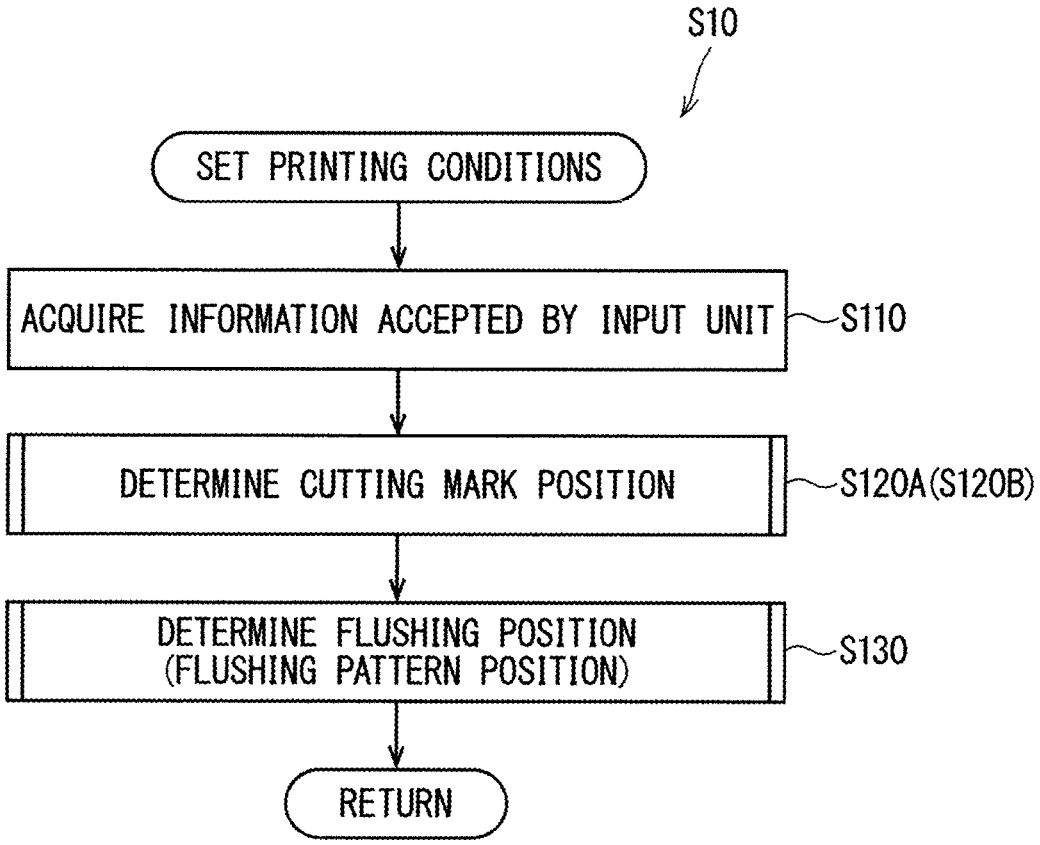
FIG. 12 A flowchart illustrating an example of the operation of the printing apparatus according to Embodiment.

When the process of Step S220 or Step S230 is completed, the process is transferred to Step S130 of FIG. 12.

Further, in FIG. 12, when the printing apparatus 3 executes Step S120B, the process is transferred to Step S310 in FIG. 14.

In Step S310, referring to the cutting mark position information d2 provided via the GUI of the input unit 142, the first determination unit 15 determines whether or not the printing target portion of the specified cutting mark is in the front end portion of the page when the cutting mark position is directly specified.

When the result of the determination in Step S310 shows that the printing target portion is on the front end portion of the page, the process proceeds to Step S320, and the first determination unit 15 determines the position of the cutting mark position at the front end portion of the page.

When the result of the determination in Step S310 shows that the printing target portion is on the rear end portion of the page, the process proceeds to Step S330, and the first determination unit 15 determines the position of the cutting mark position at the rear end portion of the page.

When the process of Step S320 or Step S330 is completed, the process is transferred to Step S130 of FIG. 12.

In Step S130 of FIG. 12, the second determination unit 16 determines the flushing position (flushing pattern position). When the second determination unit 16 starts the process of Step S130, the process is transferred to Step S410 of FIG. 15.

In Step S410, the second determination unit 16 determines whether or not the cutting mark position is at the front end portion of the page.

When the result of the determination in Step S410 shows that the cutting mark position is on the front end portion of the page, the process proceeds to Step S420, and the second determination unit 16 determines the position of the flushing position at the front end portion of the page.

When the result of the determination in Step S410 shows that the cutting mark position is not on the front end portion of the page, the process proceeds to Step S420, and the second determination unit 16 determines the position of the flushing position at the rear end portion of the page.

As described above, in the process of Step S130, the flushing pattern position is determined on one of the front end portion and the rear end portion of the page that has the cutting mark.

When the process of Step S420 or Step S430 is completed, the process is transferred to Step S20 of FIG. 11.

In Step S20, the conveyance mechanism 4 starts conveyance of the continuous paper WP in the conveyance direction Y1.

In Step S30, the print head 20 starts printing on the continuous paper WP. In the printing, an image to be printed in the image area of the page, a cutting mark to be printed in the non-image area, a flushing pattern, and the like are printed on each page of the continuous paper WP according to the setting.

For example, when flushing is performed in the offline cutting, the print head 20 prints a cutting mark on the rear end portion of a page on the continuous paper WP, and also performs flushing in which ink (ink droplets) is ejected from the plurality of nozzles 21. The print head 20 forms a line-shaped flushing pattern extending in the width direction of the continuous paper WP at the rear end portion by flushing toward the rear end portion of the page.

In Step S40, the print head 20 finishes printing on the continuous paper WP, in Step S50, the conveyance mechanism 4 finishes the conveyance of the continuous paper WP, and the printing apparatus 3 finishes the processing of the operation flow of FIG. 11.

According to the printing apparatus of Embodiment configured as described above, the print head 20 prints a cutting mark on each page of the plurality of pages on the continuous paper WP corresponding to the plurality of cut sheets CP at the rear end portion of the page in the continuous paper WP in the conveyance direction by the conveyance mechanism 4. When the conveyance direction Y1 of the continuous paper WP during printing is different from (opposed to) the conveyance direction Y2 of the continuous paper WP when cut into a plurality of cut sheets CP, the last cutting mark printed on the rear end portion of the last page during printing is first detected at the front end portion of the last printed page (the first page to be cut) when cutting continuous paper WP. Therefore, a cutting mark that allows cutting the continuous paper WP into the cut sheet CP is formed on the continuous paper WP while suppressing the consumption of the continuous paper WP.

Further, according to the printing apparatus of Embodiment, the target portion on which the cutting mark should be printed is designated between the front end portion and the rear end portion of the page, and the cutting mark is printed on the designated portion.

Further, according to the printing apparatus of Embodiment, a cutting mark on which cutting of the continuous paper WP into the cut sheet CP is performable is formed on the continuous paper WP while suppressing the consumption of the continuous paper WP, regardless of the distinction between the conveyance direction Y1 of the continuous paper WP during printing and the conveyance direction Y2 of the continuous paper WP when cutting into a plurality of cut sheets CP.

Further, according to the printing apparatus of Embodiment, when the cutting mark is printed on the rear end portion of the page on the continuous paper WP, the flushing pattern is also formed on the rear end portion; therefore, the consumption of the continuous paper WP is further suppressed than in the case where the flushing patter is formed at the end portion opposite to the cutting mark.

According to the printing apparatus according to Embodiment configured as described above, a cutting mark is printed on each page of the plurality of pages on the continuous paper WP corresponding to the plurality of cut sheets CP at the rear end portion of the page in the continuous paper WP in the conveyance direction in the conveying step. When the conveyance direction of the continuous paper WP during printing is different from (opposed to) the conveyance direction of the continuous paper WP when cut into a plurality of cut sheets CP, the last cutting mark printed on the rear end portion of the last page during printing is first detected at the front end portion of the last printed page (the first page to be cut) when cutting continuous paper WP. Therefore, a cutting mark on which cutting of the continuous paper WP into the cut sheet CP is performable is formed on the continuous paper WP while suppressing the consumption of the continuous paper WP.

In above-described Embodiment, a single post-processing machine (cutting portion 7 and paper ejection unit 5) is connected to the printing apparatus 3. However, a plurality of post-processing machines may be connected to the printing apparatus 3. For example, the printing apparatus 3 may be connected to a first post-processing machine capable of online cutting and a second post-processing machine incapable of online cutting. In this case, for the job of paper discharging to the first post-processing machine, information indicating that online cutting is performed is written, in advance, in the post-processing machine-related information d1 of the job, and for the job of paper discharging to the second post-processing machine, information indicating that online cutting is not performed is written, in advance, in the post-processing machine-related information d1 of the job.

In this case, automatic switching of the cutting mark between the front end portion (upper portion) and the rear end portion (lower portion) of the page is operable depending on the content of the job.

While the disclosure has been described in detail, the foregoing description is in all aspects illustrative and not restrictive. It should be noted that Embodiment of the present disclosure can be arbitrarily combined and can be appropriately modified or omitted without departing from the scope of the disclosure.

EXPLANATION OF REFERENCE SIGNS

100A, 100B printing system
1 paper feeding unit
3 printing apparatus
4 conveyance mechanism
5 paper ejection unit
7 cutting unit
72 sensor
73 cutter unit
20 print head
21 nozzle
WP continuous paper
CP cut sheet

The invention claimed is:

1. A printing apparatus configured to print on a continuous sheet to be cut into a plurality of cut sheets at a plurality of cutting positions arranged in a longitudinal direction while being conveyed in the longitudinal direction, comprising:

a conveyance mechanism configured to convey the continuous sheet in the longitudinal direction; and a print head provided so as to face a conveyance path for the continuous sheet in the conveyance mechanism and configured to sequentially print a plurality of cutting marks indicating the plurality of cutting positions on the continuous sheet being conveyed by the conveyance mechanism, wherein, from between front end portions and rear end portions of each of the pages in a conveyance direction of the continuous sheet in the conveyance mechanism when printing by the print head is performed, the print head prints the cutting marks on the rear end portions for a plurality of pages on the continuous sheet corresponding to the plurality of cut sheets, the printing apparatus further comprising:

a reception unit configured to accept designation that, from between the front end portions and the rear end portions of the pages, ones that are designated as the target portions at which the cutting marks to be printed, wherein when the reception unit accepts the designation that the front end portions of the pages are the target portions, the print head prints the cutting marks at the front end portions of the pages, and when the reception unit accepts the designation that the rear end portions of the pages are the target portions, the print head prints the cutting marks at the rear end portions of the pages.

2. A printing apparatus configured to print on a continuous sheet to be cut into a plurality of cut sheets at a plurality of cutting positions arranged in a longitudinal direction while being conveyed in the longitudinal direction, comprising:

a conveyance mechanism configured to convey the continuous sheet in the longitudinal direction; and a print head provided so as to face a conveyance path for the continuous sheet in the conveyance mechanism and configured to sequentially print a plurality of cutting marks indicating the plurality of cutting positions on the continuous sheet being conveyed by the conveyance mechanism, wherein, from between front end portions and rear end portions of each of the pages in a conveyance direction of the continuous sheet in the conveyance mechanism when printing by the print head is performed, the print head prints the cutting marks on the rear end portions for a plurality of pages on the continuous sheet corresponding to the plurality of cut sheets, the printing apparatus further comprising:

an information acquisition unit configured to acquire information indicating whether or not a first conveyance direction of the continuous sheet in the conveyance mechanism when the printing by the print head is performed and a second conveyance direction of the continuous sheet when the continuous sheet is cut into the plurality of cut sheets are a same; and a determination unit configured to determine the front end portions of the pages as target portions at which the cutting marks to be printed when the first conveyance direction and the second conveyance direction are the same, and determine the rear end portions of the pages as target portions at which the cutting marks to be printed when the first conveyance direction is different from the second conveyance direction in the information acquired by the information acquisition unit, wherein the print head prints the cutting marks on the target portions of the pages.

3. The printing apparatus according to claim 2, wherein the information acquisition unit accepts post-processing machine-related information about a post-processing machine that processes the continuous sheet on which the print head has finished printing and determines the target portions at which the cutting marks to be printed based on the post-processing machine-related information.

4. The printing apparatus according to claim 3, wherein the post-processing machine-related information is written, as an image information, in a job provided to the printing apparatus, and the information acquisition unit determines the target portions at which the cutting marks to be printed based on the post-processing machine-related information extracted from the job.

5. The printing apparatus according to claim 3, wherein the post-processing machine-related information is output by a detection sensor configured to detect the post-processing machine connected to the printing apparatus.

6. A printing method of printing on a continuous sheet to be cut into a plurality of cut sheets at a plurality of cutting positions arranged in a longitudinal direction while being conveyed in the longitudinal direction, comprising:

a conveying step of conveying the continuous sheet in the longitudinal direction; and a printing step of sequentially printing a plurality of cutting marks indicating the plurality of cutting positions on the continuous sheet being conveyed in the step of conveying, wherein the printing step is a step which, from between front end portions and rear end portions of each of the pages in a conveyance direction of the continuous sheet in the printing step, the cutting marks are printed on the rear end portions for a plurality of pages on the continuous sheet corresponding to the plurality of cut sheets, the printing method further comprising a receiving step of accepting designation that ones from between the front end portions and the rear end portions of the pages are designated as the target portions at which the cutting marks to be printed, wherein the printing step includes a step of printing the cutting marks on the front end portions of the pages when the designation is accepted in which the front end portions of the pages are designated as the target portions in the reception step, and a step of printing the cutting marks on the rear end portions of the pages when the designation is accepted in which the rear end portions of the pages are designated as the target portions in the reception step.

7. A printing method of printing on a continuous sheet to be cut into a plurality of cut sheets at a plurality of cutting positions arranged in a longitudinal direction while being conveyed in the longitudinal direction, comprising:

a conveying step of conveying the continuous sheet in the longitudinal direction; and a printing step of sequentially printing a plurality of cutting marks indicating the plurality of cutting positions on the continuous sheet being conveyed in the step of conveying, wherein the printing step is a step which, from between front end portions and rear end portions of each of the pages in a conveyance direction of the continuous sheet in the printing step, the cutting marks are printed on the rear end portions for a plurality of pages on the continuous sheet corresponding to the plurality of cut sheets, the printing method further comprising an information acquisition step of acquiring information indicating whether or not a first conveyance direction of the continuous sheet in the conveying step and a second conveyance direction of the continuous sheet when the continuous sheet is cut into the plurality of cut sheets are a same; and a determination step of determining the front end portions of the pages as target portions at which the cutting marks to be printed when the first conveyance direction and the second conveyance direction are the same, and determining the rear end portions of the pages as target portions at which the cutting marks to be printed when the first conveyance direction is different from the second conveyance direction in the information, wherein the printing step is a step of printing the cutting marks on the target portions of the pages.

* * * * *